US006894579B2

(12) United States Patent
Brown et al.

(10) Patent No.: US 6,894,579 B2
(45) Date of Patent: May 17, 2005

(54) CIRCULATORS AND ISOLATORS WITH VARIABLE OPERATING REGIONS

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 208 days.

(21) Appl. No.: 10/330,761

(22) Filed: Dec. 27, 2002

(65) Prior Publication Data

US 2004/0124939 A1 Jul. 1, 2004

(51) Int. Cl.[7] ..... H01P 1/383
(52) U.S. Cl. ..... 333/1.1; 333/24.2
(58) Field of Search ..... 333/1.1, 24.2

(56) References Cited

U.S. PATENT DOCUMENTS 4,771,252 A * 9/1988 Morz et al. ..... 333/1.1
5,128,635 A * 7/1992 Vaughan et al. ..... 333/1.1

OTHER PUBLICATIONS

U.S. patent application Ser. No. 10/421,050, Brown, et al., filed Apr. 23, 2003.
U.S. patent application Ser. No. 10/421,400, Brown, et al., filed Apr. 23, 2003.
Wolfgang Borschel, "*Circulators and Ring Hybrids*", VHF Communications, Mar. 2000, pp. 179–185.

* cited by examiner

*Primary Examiner*—Stephen E. Jones
(74) *Attorney, Agent, or Firm*—Sacco & Associates, PA

(57) ABSTRACT

A circulator (100) is comprised of a transmission line three port Y junction (104). At least one cylindrical cavity structure (113, 115) is disposed adjacent to the Y junction and contains a ferromagnetic fluid (114). One or more magnets (112) are provided for applying a magnetic field (118) to the ferromagnetic fluid and the Y junction in a direction normal to a plane defined by said Y junction. A composition processor (301) is provided for dynamically changing a composition of the ferromagnetic fluid in response to a control signal to vary the permittivity and permeability of the ferromagnetic fluid.

26 Claims, 4 Drawing Sheets

CIRCULATORS AND ISOLATORS WITH VARIABLE OPERATING REGIONS

BACKGROUND OF THE INVENTION

1. Statement of the Technical Field

The present invention relates to the field of circulators and isolators, and more particularly to circulators and isolators that have variable RF properties.

2. Description of the Related Art

Circulators and isolators are devices that typically have three or more ports arranged in a ring and which provide unique RF transmission paths. An isolator is a three port circulator in which the third one of the ports has been terminated. Accordingly, for convenience, references to circulators herein shall be understood to also include isolators. Each type of device provides one way sequential transmission of power between its ports. For example, power in at port 1 couples only to port 2 with the exclusion of all other ports. More particularly, circulators and isolators are designed to allow RF energy to pass from a first port to a second port in a forward direction with little or no insertion loss, but present a high degree of attenuation for RF energy passing in a reversed direction from the second port to the first port. Similarly, RF energy is allowed to pass from the second port to a third port with low insertion loss, but is highly attenuated in the direction from the third port to the second port.

Circulators are often used to allow a receiver and a transmitter to share a common antenna by connecting a transmitter to port 1, an antenna to port 2 and a receiver to port 3. This arrangement provides for concurrent transmission and reception of signals. The antenna is always connected to the receiver and the transmitter but the receiver is isolated from the transmitted signals.

Most commonly, the fabrication of a circulator generally involves a three port Y junction of either rectangular waveguides or stripline that is loaded with ferrite cylinders or discs that are magnetized in a direction normal to the plane of the junction. Notably, while most circulators use a fixed direction of magnetic field and circulation, it is known in the art that the direction of circulation can be reversed by reversing the direction of the biasing magnetic field. This feature can be used to affect RF switching.

The ferrite discs used in circulators and isolators are typically formed from an iron powder that has been treated to produce an oxide layer on the outer surface. This oxide layer effectively insulates each iron particle from the next. The powder is mixed with a (non magnetic) ceramic bonding material and heated to form a rigid ceramic disc. Most common ferrite contains about 50% iron oxide. The remainder is typically either an oxide of manganese (Mn) and zinc (Zn) or nickel and zinc. Other types of ferrites can also be used to form the disc.

The operating frequency of circulators and isolators is primarily determined by the ferrimagnetic resonance frequency of the ferrite disk. The frequency of ferrimagnetic resonance can be affected by several factors including the diameter, permeability, and dielectric constant or permittivity of the ferrite disk. Maximum coupling of the energy from the RF signal to the ferrite material will occur at ferrimagnetic resonance. Accordingly, for reasons of efficiency, circulators and isolators are generally designed to operate either below ferrimagnetic resonance or above ferrimagnetic resonance. The operating frequency for below resonance (B/R) circulators are generally limited to the range from about 500 MHz to more than 30 GHz. By comparison, the practical range of operating frequencies for above resonance (A/R) circulators is lower, namely from about 50 MHz to approximately 2.5 GHz. From the foregoing, it may be observed that it can be difficult to design a single circulator capable of operating over a broad range of frequencies substantially below 500 MHz and more than 2.5 GHz.

Ferromagnetic materials (e.g. iron, nickel, cobalt, and various alloys) have atomic or molecular or crystalline magnetic dipole moments that exhibit a paramagnetic (i.e. positive feedback) response to magnetic fields. These dipole moments tend to align with the magnetic field but the alignment is disrupted by thermal motion of the atoms or molecules. In ferromagnetic materials, it is energetically favorable for all the dipole moments to be aligned. In at least some ferromagnetic materials, the field produced by the aligned dipoles is sufficient to maintain the alignment below the Curie temperature, thereby resulting in permanent magnets.

In ferrimagnetic materials, sometimes called ferrites, it is energetically favorable for neighboring dipole moments to be antiparallel but different types of atoms are present and the dipole moments do not cancel exactly. There can thus be a net positive dipole moment. Ferrimagnetic materials spontaneously subdivide into domains, small regions where all dipoles are parallel. The division into domains is such that total energy in the domain boundaries and fields is minimized. Arrangement of domains can be manipulated by externally applied electrical fields. It also influences the magnetic response of the material. These two properties are extremely useful in certain applications.

SUMMARY OF THE INVENTION

The invention concerns a circulator in which the operating region can be varied so as to be above or below ferrimagnetic resonance. The circulator is comprised of a transmission line three port Y junction. At least one, and preferably two, cylindrical cavity structures are disposed adjacent to the Y junction and contain a ferromagnetic fluid. One or more magnets are provided for applying a magnetic field to the ferromagnetic fluid and the Y junction in a direction normal to a plane defined by the Y junction. A composition processor is provided for dynamically changing a composition of the ferromagnetic fluid in response to a control signal to vary the permittivity and permeability of the ferromagnetic fluid.

The cavity containing the ferromagnetic fluid has a ferrimagnetic resonance, and the change of the composition of the ferromagnetic fluid causes a change in the ferrimagnetic resonance. By changing the ferrimagnetic resonance, an operating region of the circulator can be selected to be either above ferrimagnetic resonance or below ferrimagnetic resonance. More particularly, the change in composition of the ferromagnetic fluid causes a change in the operating region. According to one aspect of the invention, a plurality of component parts can be dynamically mixed together in the composition processor responsive to the control signal to form the ferromagnetic fluid. The component parts can be selected from the group consisting of a low permittivity, low permeability component, a high permittivity, low permeability component, and a high permittivity, high permeability component.

The composition processor can also include a component part separator system for separating the component parts of the ferromagnetic fluid for subsequent reuse.

According to another aspect, the ferromagnetic fluid can be comprised of an industrial solvent and a suspension of magnetic particles contained therein. The magnetic particles can be formed of a material selected from the group consisting of ferrite, metallic salts, and organo-metallic particles and the ferromagnetic fluid comprise between about 50% to 90% of the magnetic particles by weight.

DETAILED DESCRIPTION OF THE INVENTION

Figure 1:
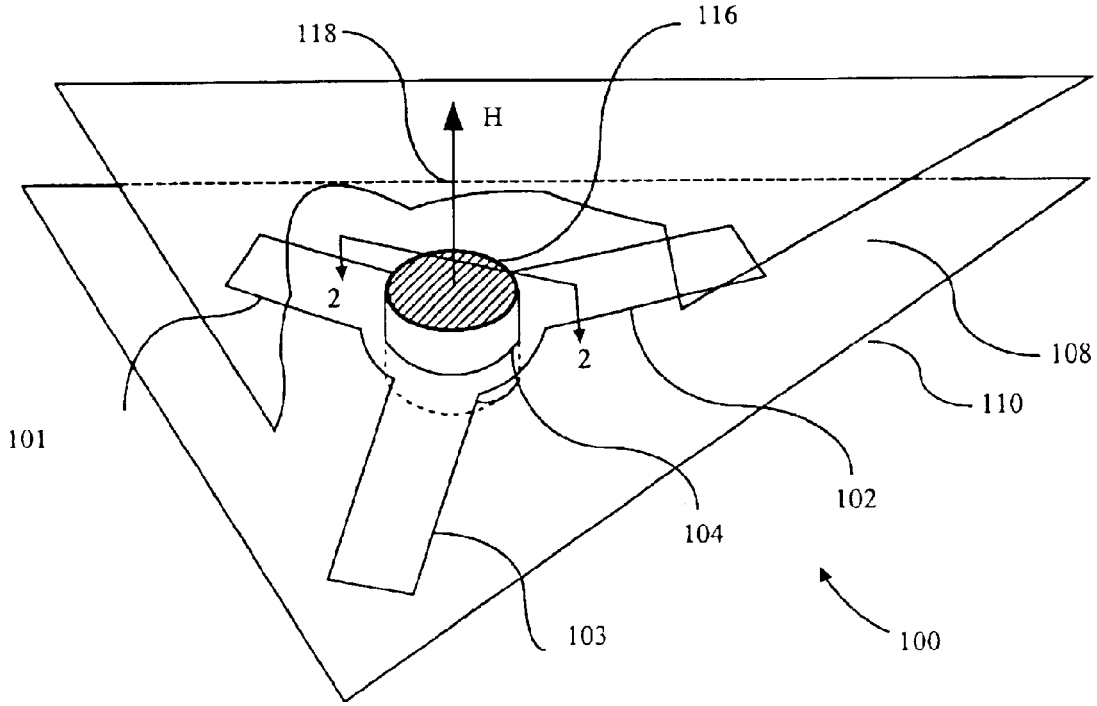
FIG. 1 is a perspective view of a circulator that is useful for understanding the invention.

FIG. 1 is a perspective view of a circulator 100 that is useful for understanding the invention. For convenience, the term circulator as used herein should also be understood to also include isolators, which are really a special case of a circulator. As illustrated in FIG. 1, the circulator is comprised of metal case 116 and three transmission line ports 101, 102, 103 that are terminated in a Y junction 104. Electric ground planes 108, 110 are shown above and below the transmission line ports 101, 102, and 103.

Figure 2:
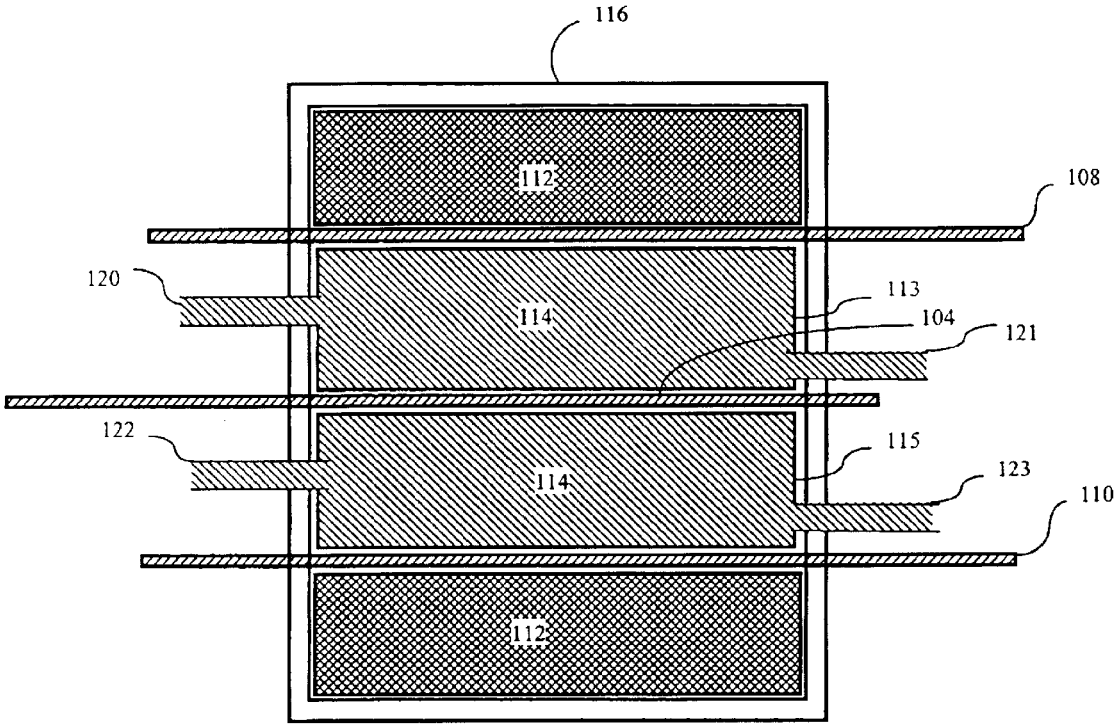
FIG. 2 is a cross-sectional view of the circulator of FIG. 1, taken along lines 2—2.

Referring now to FIG. 2, it can be seen that the circulator includes several components within the metal case 116. In conventional circulators, ferrite discs are positioned in the area between the transmission line Y junction 104 and the electric ground planes 108, 110. In the present invention, however, the ferrite discs are preferably eliminated in favor of ferromagnetic fluid 114 that is contained within cylindrical cavity structures 113, 115. Magnets 112 are preferably provided above and below electric ground planes 108 and 110, respectively. These can be either permanent magnets or electromagnets. The metal case 116 is preferably formed of steel or aluminum with steel cladding to provide a magnetic return circuit.

A fluid suspension of ferromagnetic particles can behave ferrimagnetically, with the suspended particles acting the role of domains. In such cases, it will be energetically favorable for the particles to pair up in antiparallel sets (this can be visualized as particle sized bar magnets in suspension.) The exact response of the ferromagnetic fluid will depend on the shape and size distribution of the particles. For example, disk shaped particles will behave differently as compared to bar magnets. Significantly, however, the ferromagnetic fluid can be selected to have a ferrimagnetic resonance that is similar to the conventional type ferrite disks that are presently used in circulators and isolators.

In the absence of a magnetic field, an RF signal applied at a transmission line port 101 will be transferred equally to ports 102 and 103, provided that all of the transmission lines are equally spaced from one another. This power transfer is due to a pattern of standing waves that are established relative to the input transmission line port 101. These standing waves are symmetrical relative to the input transmission line port 101. However, when an axial magnetic field 118 is applied to the ferromagnetic fluid 114 in cavity structures 113, 115, the presence of such axial magnetic field alters the symmetrical pattern of standing waves.

As is known from conventional circulator design, the desired characteristics of circulation and isolation are obtained by causing the standing wave pattern to rotate approximately 30 degrees. With the magnetic field oriented in a first axial direction, it will produce a null at transmission line port 102, making it the isolation port. The shift in standing wave pattern also causes transmission line port 103 to be fully coupled to the input port 101. Those skilled in the art will appreciate that the invention is not limited to one particular direction of circulation. Rather, a direction of circulation, and the coupling or isolation of the ports, will be determined by the axial direction of the magnetic field. Reversing the direction of the magnetic field reverses the direction of circulation.

The operational frequency of the circulator will be determined substantially by the ferrimagnetic resonance frequency of the ferromagnetic fluid 114 contained in cylindrical cavity structures 113 and 115. The ferrimagnetic resonance frequency can be selected by controlling one or more of several-design parameters, including the cavity diameter, permeability, and dielectric constant or permittivity of the ferrite disk. In general, for A/R operation the ferromagnetic fluid will need to have a higher effective permeability as compared to the permeability required for B/R operation. According to a preferred embodiment of the invention, the permeability and dielectric constant of the ferromagnetic fluid can be dynamically controlled to select the ferrimagnetic resonance frequency and thereby obtain efficient circulator operation over a range of RF frequencies not otherwise obtainable.

More particularly, it is known that circulators and isolators are generally designed to operate either below ferrimagnetic resonance or above ferrimagnetic resonance. The operating frequency for below resonance (B/R) circulators are generally limited to the range from about 500 MHz to more than 30 GHz. By comparison, the practical range of operating frequencies for above resonance (A/R) circulators is lower, namely from about 50 MHz to approximately 2.5 GHz. At high frequencies, the A/R circulator requires a very high intensity magnetic field to operate efficiently. Therefore, in order to obtain efficient operation of a circulator over a range of frequencies that extend substantially below about 500 MHz and substantially above about 2.5 GHz, it can be advantageous to selectively control the characteristics of the ferromagnetic fluid contained in the cylindrical cavity structures 113, 115. This will allow the ferromagnetic resonance frequency to be dynamically changed. Consequently, the circulator can be configured to operate above ferrimagnetic resonance for lower operating frequencies, and below ferrimagnetic resonance when the device is used for higher operating frequencies.

In addition to allowing control over the ferrimagnetic resonance frequency, dynamic control over the permeability and permittivity of the ferromagnetic fluid can also permit the impedance of the ferromagnetic fluid contained in the cylindrical cavity structures to be adjusted for an improved match at different frequencies of operation. This ability to adjust impedance can help to reduce the need for external transformer sections as are commonly required for broad bandwidth circulator applications.

Composition of Ferromagnetic Fluid

The ferromagnetic fluid as described herein can be comprised of several component parts that can be mixed together to produce a desired permeability and permittivity required for a particular ferromagnetic resonance and Y junction impedance. The mixture preferably has a relatively low loss tangent to minimize the amount of RF energy that is lost. The component parts can be selected to include a first fluid made of a high permittivity solvent completely miscible with a second fluid made of a low permittivity oil that has a significantly different boiling point. A third fluid component can be comprised a ferrite particle suspension in a low permittivity oil identical to the first fluid such that the first and second fluids do not form azeotropes.

A nominal value of relative permittivity ($\epsilon_r$) for fluids is approximately 2.0. However, a mixture of such component parts can be used to produce a wide range of permittivity values. For example, component fluids could be selected with permittivity values of approximately 2.0 and about 58 to produce a ferromagnetic fluid with a permittivity anywhere within that range after mixing. Dielectric particle suspensions can also be used to increase permittivity.

According to a preferred embodiment, the component parts of the ferromagnetic fluid can be selected to include a high permeability component. High levels of magnetic permeability are commonly observed in magnetic metals such as Fe and Co. For example, solid alloys of these materials can exhibit levels of $\mu$ in excess of one thousand. By comparison, the permeability of fluids is nominally about 1.0 and they generally do not exhibit high levels of permeability. However, high permeability can be achieved in a fluid-by introducing magnetic particles/elements to the fluid. For example typical magnetic fluids comprise suspensions of iron, ferro-magnetic or ferrite particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed ferromagnetic fluid. However, magnetic fluid compositions are typically between about 50% to 90% particles by weight.

Increasing the number of particles will generally increase the permeability.

Processing of Ferromagnetic Fluid For Mixing/Unmixing of Components

Figure 3:
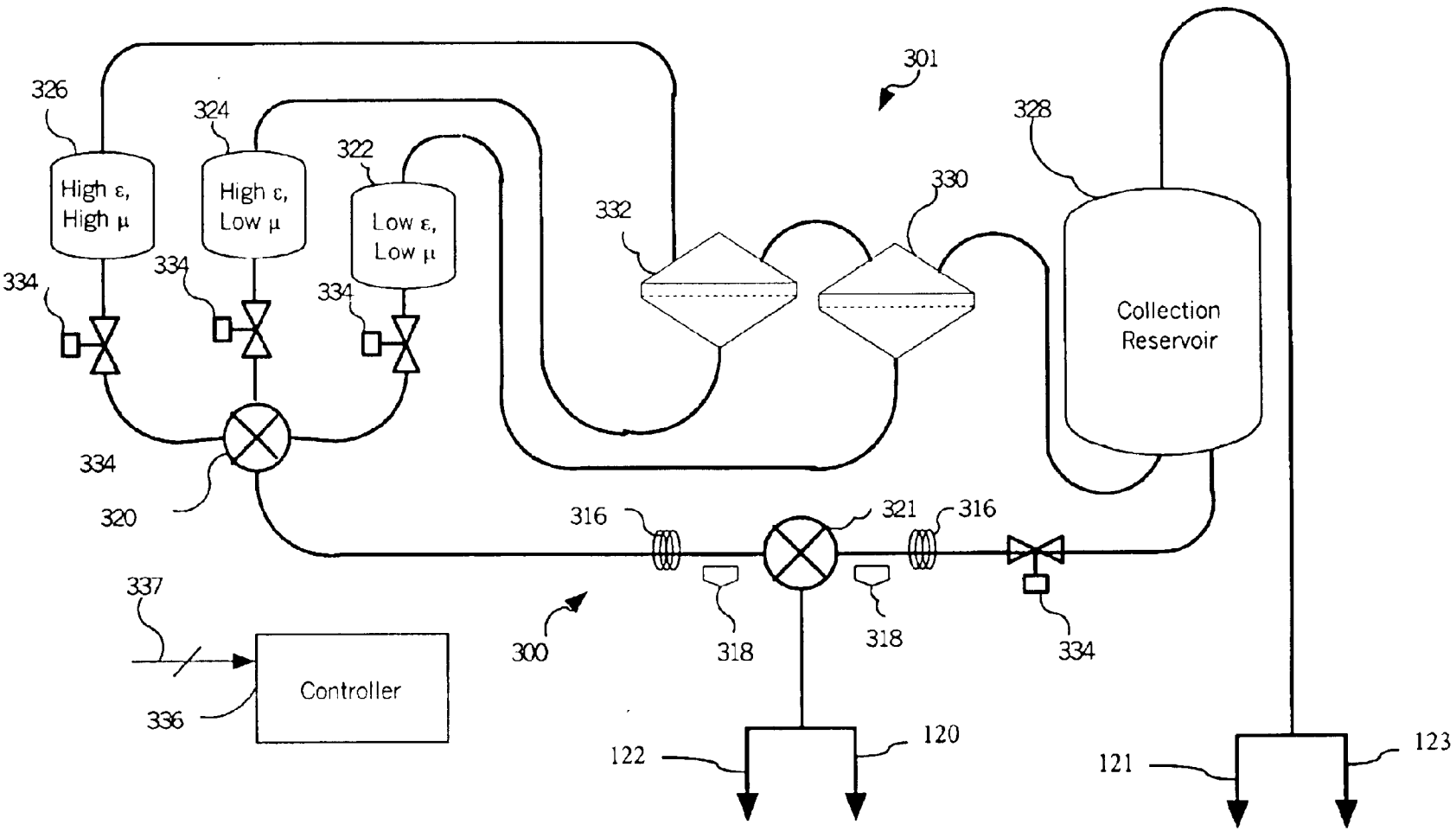
FIG. 3 is a schematic representation of a composition processor for varying the composition of a ferromagnetic fluid.

A schematic representation of a composition processor for varying the composition of a ferromagnetic fluid is illustrated in FIG. 3. The composition processor 301 can be comprised of a plurality of fluid reservoirs containing component parts of ferromagnetic fluid 114. These can include a first fluid reservoir 322 for a low permittivity, low permeability component of the ferromagnetic fluid, a second fluid reservoir 324 for a high permittivity, low permeability component of the ferromagnetic fluid, and a third fluid reservoir 326 for a high permittivity, high permeability component of the ferromagnetic fluid. Those skilled in the art will appreciate that other combinations of component parts may also be suitable and the invention is not intended to be limited to the specific combination of component parts described herein.

Figure 4:
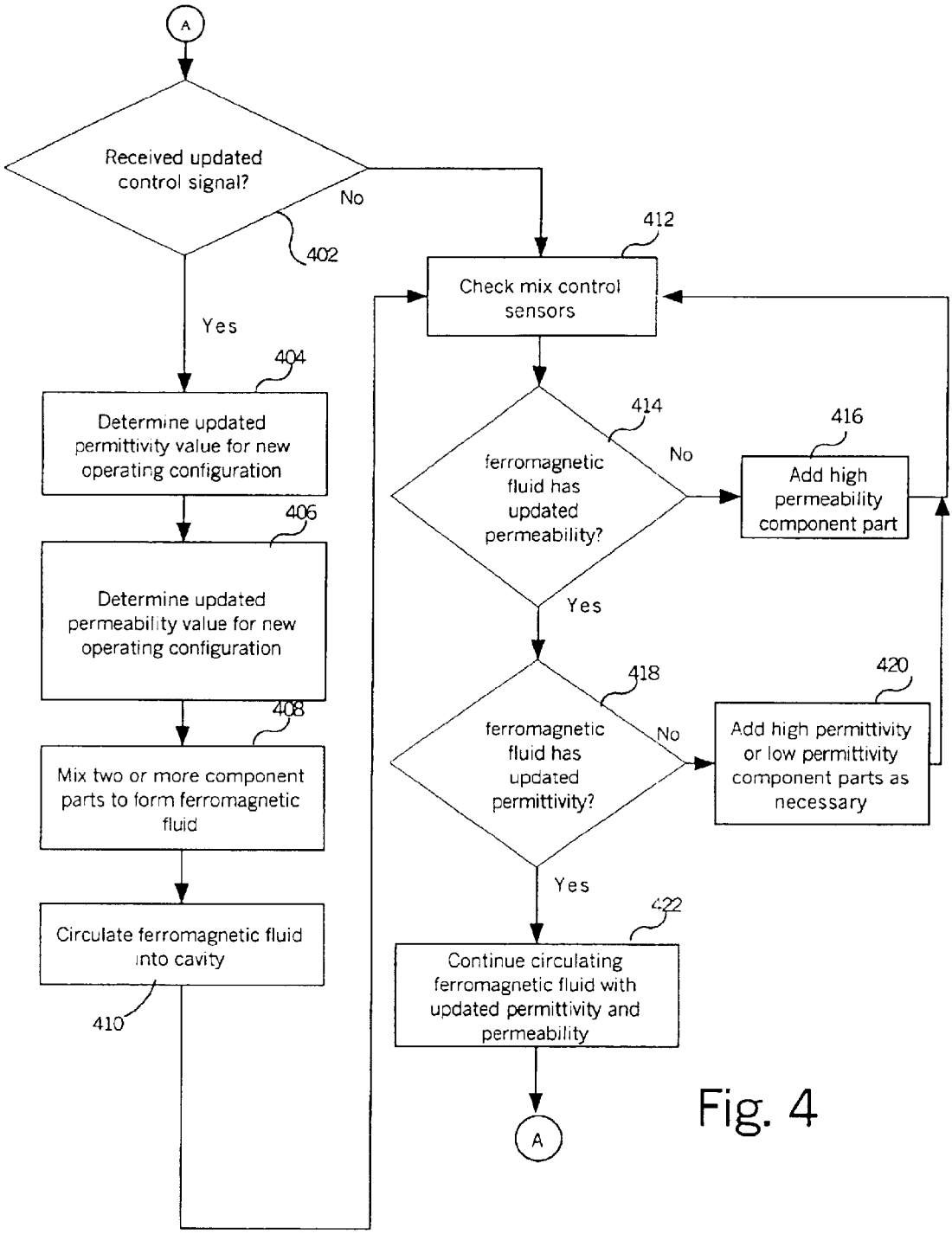
FIG. 4 is a flowchart illustrating a process that can be used for dynammically preparing a ferromagnetic fluid.

A cooperating set of proportional valves 334, mixing pumps 320, 321, and connecting conduits 120, 121, 122, 123 can be provided as shown in FIG. 3 for selectively mixing and communicating the components of the ferromagnetic fluid 114 from the fluid reservoirs 322, 324, 326 to cylindrical cavity structures 113 and 115. The composition processor also serves to separate out the component parts of ferromagnetic fluid 114 so that they can be subsequently reused to form the ferromagnetic fluid with different permittivity and/or permeability values. All of the various operating functions of the composition processor can be controlled by controller 336. The operation of the composition processor shall now be described in greater detail with reference to FIG. 3 and the flowchart shown in FIG. 4.

The process can begin in step 402 of FIG. 3, with controller 336 checking to see if an updated configuration control signal has been received on a control signal input line 337. If so, then the controller 337 continues on to step 404 to determine an updated permittivity value for the new circulator configuration. The updated permittivity value necessary for achieving circulator operating parameters is preferably determined using a look-up table but can be calculated directly based on the specific operating configuration indicated by the control signal. In step 406, the controller can determine an updated permeability value required for the updated circulator configuration. In step 408, the controller 336 causes the composition processor 301 to begin mixing two or more component parts in a proportion to form a ferromagnetic fluid that has the updated permittivity and permeability values determined earlier. This mixing process can be accomplished by any suitable means. For example, in FIG. 3 a set of proportional valves 334 and mixing pump 320 are used to mix component parts from reservoirs 322, 324, 326 appropriate to achieve the desired updated permeability and permittivity.

In step 410, the controller causes the newly mixed ferromagnetic fluid 114 to be circulated into the cavities defined by cylindrical cavity structures 113 and 115 through a second mixing pump 321. The ferromagnetic fluid can be communicated to the cavities defined within cavity structures 113 and 115 through conduits 120, 122 and excess fluid can be re-circulated to the composition processor through the conduits 121, 123. In step 412, the controller can check one or more sensors 316, 318 to determine if the ferromagnetic fluid being circulated to the cavity structures 113 and 115 has the proper values of permeability and permittivity. Sensors 316 are preferably inductive type sensors capable of measuring permeability. Sensors 318 are preferably capacitive type sensors capable of measuring permittivity. The sensors can be located as shown, at the input to mixing pump 321. Sensors 316, 318 can also be positioned along conduits 122, 120, and 121, 123 to measure the permeability and permittivity of the ferromagnetic fluid passing into and/or out of the cavity structures 113, 115. Note that it can be desirable to have a second set of sensors 316, 318 at or near the cavity structures 113 and 115 so that the controller can determine when the ferromagnetic fluid with updated permittivity and permeability values has completely replaced any previously used ferromagnetic fluid that may have been present in the cavity structures 113 and 115.

In step 414, the controller 336 can compare the measured permeability to the desired updated permeability value determined in step 406. If the ferromagnetic fluid does not have the proper updated permeability value, the controller 336 can cause additional amounts of high permeability component part to be added to the mix from reservoir 326.

If the ferromagnetic fluid is determined to have the proper level of permeability in step 414, then the process continues on to step 418 where the measured permittivity value from step 412 is compared to the desired updated permittivity value from step 404. If the updated permittivity value has not been achieved, then high or low permittivity component parts are added as necessary in step 410. If both the permittivity and permeability passing into and out of the cavities defined by cavity structures 113 and 115 are the proper value, the system can stop circulating the ferromagnetic fluid and the system returns to step 402 to wait for the next updated time delay control signal.

Significantly, when updated ferromagnetic fluid is required, any existing ferromagnetic fluid can be circulated out of the cavity structures 113 and 115. Any existing ferromagnetic fluid not having the proper permeability and/or permittivity can be deposited in a collection reservoir 328. The ferromagnetic fluid deposited in the collection reservoir can thereafter be re-used directly as a fourth fluid by mixing with the first, second, and third fluids or separated out into its component parts in separator units 330, 332 so that it may be re-used, at a later time to produce additional ferromagnetic fluid. The aforementioned approach includes a method for sensing the properties of the collected fluid mixture to allow the fluid processor to appropriately mix the desired composition, and thereby, allowing a reduced volume of separation processing to be required.

An example of a set of component parts that could be used to produce a ferromagnetic fluid as described herein would include oil (low permittivity, low permeability), a solvent (high permittivity, low permeability) and a magnetic fluid, such as combination of an oil and a ferrite (low permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing the same hydrocarbon fluid with magnetic particles such as magnetite manufactured by Ferro Tec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture.

Solvents such as formamide inherently posses a relatively high permittivty and therefore can be used as the high permittivity component of the ferromagnetic fluid for the invention. Permittivity of other types of fluid can also be increased by adding high permittivity powders such as barium titanate manufactured by Ferro Corporation of Cleveland, Ohio. For broadband applications, the fluids would not have significant resonances over the frequency band of interest. Given the foregoing, the following process may be used to separate the component parts.

A first stage separation process in separator unit 330 would utilize distillation to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir 322. A second stage process would introduce the mixture, free of the first fluid, into a chamber that includes an electromagnet that can be selectively energized to attract and hold the paramagnetic particles while allowing the pure second fluid to pass which is then diverted to the second fluid reservoir 324. Upon de-energizing the electromagnet, the third fluid would be recovered by allowing the previously trapped magnetic particles to combine with the fluid exiting the first stage which is then diverted to the third fluid reservoir 326.

Those skilled in the art will recognize that the specific process used to separate the component parts from one another will depend largely upon the properties of material that are selected and the invention. Accordingly, the invention is not to be limited to the particular process outlined above.

We claim:

1. A circulator, comprising:

a transmission line three port Y junction;

at least one cylindrical cavity structure disposed adjacent to said Y junction and containing a ferromagnetic fluid; and at least one magnet for applying a magnetic field to said ferromagnetic fluid and said Y junction, said magnetic field applied in a direction normal to a plane defined by said Y junction.

2. The circulator according to claim 1, further comprising a composition processor adapted for dynamically changing a composition of said ferromagnetic fluid in response to a control signal to vary at least one of a permittivity and a permeability of said ferromagnetic fluid.

3. The circulator according to claim 2 wherein said ferromagnetic fluid contained within said cylindrical cavity structure has a ferrimagnetic resonance, and said change of said composition of said ferromagnetic fluid causes a change in said ferrimagnetic resonance.

4. The circulator according to claim 2 wherein said circulator has an operating region above ferrimagnetic resonance and below ferrimagnetic resonance, and said change of said composition of said ferromagnetic fluid causes a change in said operating region.

5. The circulator according to claim 2 wherein a plurality of component parts are dynamically mixed together in said composition processor responsive to said control signal to form said ferromagnetic fluid.

6. The circulator according to claim 5 wherein said component parts are selected from the group consisting of a low permittivity, low permeability component, a high permittivity, low permeability component, and a high permittivity, high permeability component.

7. The circulator according to claim 6 wherein said composition processor further comprises at least one proportional valve, at least one pump, and at least one conduit for selectively mixing and communicating a plurality of said components of said ferromagnetic fluid from respective fluid reservoirs to said at least one cylindrical cavity structure.

8. The circulator according to claim 7 wherein said composition processor further comprises a component part separator comprising a system for separating said component parts of said ferromagnetic fluid for subsequent reuse.

9. The circulator according to claim 1 wherein said ferromagnetic fluid is comprised of an industrial solvent.

10. The circulator according to claim 1 wherein at least one component of said ferromagnetic fluid is comprised of an industrial solvent having a suspension of magnetic particles contained therein.

11. The circulator according to claim 10 wherein said magnetic particles are formed of a material selected from the group consisting of ferrite, metallic salts, and organometallic particles.

12. The circulator according to claim 11 wherein said component contains between about 50% to 90% of said magnetic particles by weight.

13. The circulator according to claim 1 wherein said ferromagnetic fluid is comprised of magnetic particles and hydrocarbon dielectric oil.

14. The circulator according to claim 13 wherein said magnetic particles are comprised of a metal selected from the group consisting of iron, nickel, manganese, and zinc.

15. A method for varying an operating region of a circulator, comprising:

positioning at least one cylindrical cavity structure containing a ferromagnetic fluid adjacent to a transmission line Y junction; magnetically biasing said ferromagnetic fluid and said Y junction with a magnetic field applied in a direction normal to a plane defined by said Y junction; and dynamically changing a composition of said ferromagnetic fluid in response to a control signal to vary at least one of a permittivity and a permeability of said ferromagnetic fluid.

16. The method according to claim 15 further comprising the step of selectively changing said composition of said ferromagnetic fluid so as to cause a change in a ferrimagnetic resonance of said ferromagnetic fluid contained in said cylindrical cavity structure.

17. The method according to claim 15 further comprising the step of changing said composition of said ferromagnetic fluid so as to change an operating region of said circulator to at least one of above ferrimagnetic resonance and below ferrimagnetic resonance.

18. The method according to claim 15 further comprising the step of dynamically mixing together a plurality of component parts responsive to said control signal to form said ferromagnetic fluid.

19. The method according to claim 18 further comprising the step of selecting said component parts from the group consisting of a low permittivity, low permeability component, a high permittivity, low permeability component, and a high permittivity, high permeability component.

20. The method according to claim 19 further comprising the step of communicating said ferromagnetic fluid from a fluid composition processor to said at least one cylindrical cavity structure.

21. The method according to claim 20 further comprising the step of separating said component parts of said ferromagnetic fluid for subsequent reuse.

22. The method according to claim 15 further comprising the step of forming said ferromagnetic fluid as a mixture of an industrial solvent and a suspension of magnetic particles.

23. The method according to claim 22 further comprising the step of selecting said magnetic particles to be made of a material selected from the group consisting of ferrite, metallic salts, and organo-metallic particles.

24. The method according to claim 22 further comprising the step of selecting said ferromagnetic fluid to include between about 50% to 90% of said magnetic particles by weight.

25. The method according to claim 15 further comprising the step of selecting said ferromagnetic fluid to be comprised of magnetic particles and hydrocarbon dielectric oil.

26. The method according to claim 25 further comprising the step of selecting said magnetic particles from the group consisting of iron, nickel, manganese, and zinc.

* * * * *